US005594931A

United States Patent [19]

Krall et al.

[11] Patent Number: 5,594,931

[45] Date of Patent: Jan. 14, 1997

[54] LAYERED COMPOSITE CARBIDE PRODUCT AND METHOD OF MANUFACTURE

[75] Inventors: Jack Krall; Rodger Plyler, both of Latrobe, Pa.

[73] Assignee: Newcomer Products, Inc., Latrobe, Pa.

[21] Appl. No.: 437,869

[22] Filed: May 9, 1995

[51] Int. Cl.[6] ..... B22F 3/10; B22F 7/02

[52] U.S. Cl. ..... 419/5; 419/10; 419/14; 419/36

[58] Field of Search ..... 419/5, 10, 14, 419/36

[56] References Cited

U.S. PATENT DOCUMENTS

| | | | |
|---|---|---|---|
| 3,617,358 | 11/1971 | Dittrich | 117/105.2 |
| 3,989,863 | 11/1976 | Jackson et al. | 427/367 |
| 4,003,716 | 1/1977 | Steigelman et al. | 29/182.7 |
| 4,228,214 | 10/1980 | Steigelman et al. | 428/212 |
| 4,398,952 | 8/1983 | Drake | 419/18 |
| 4,478,888 | 10/1984 | Benjamin et al. | 427/220 |
| 4,491,559 | 1/1985 | Grab et al. | 419/36 |
| 4,615,918 | 10/1986 | Reichert et al. | 427/385.5 |
| 4,642,298 | 2/1987 | Kuramoto et al. | 501/96 |
| 4,722,405 | 2/1988 | Langford, Jr. | 175/374 |
| 4,743,515 | 5/1988 | Fischer et al. | 428/698 |
| 4,917,842 | 4/1990 | Currie et al. | 264/56 |
| 4,956,012 | 9/1990 | Jacobs et al. | 75/236 |
| 5,080,672 | 1/1992 | Bellis | 623/16 |
| 5,333,520 | 8/1994 | Fischer et al. | 76/108.2 |
| 5,335,738 | 8/1994 | Waldenstrom et al. | 175/420.2 |
| 5,364,513 | 11/1994 | Sekhar et al. | 204/243 R |

FOREIGN PATENT DOCUMENTS

| | | |
|---|---|---|
| 49736/85 | 6/1985 | Australia . |
| 0542704A1 | 11/1993 | European Pat. Off. . |
| 1274211 | 5/1972 | United Kingdom . |

OTHER PUBLICATIONS

Mistler, R. E., "Tape Casting: The Basic Process for Meeting the Needs of the Electronic Industry", Ceramic Bulletin, vol. 69, No. 6, 1990, pp. 1022–1026.

Newcomer Products Inc., Turning Center Catalog, "Standards of the Industry", pp. 2–3.

*Primary Examiner*—Charles T. Jordan
*Assistant Examiner*—Daniel Jenkins
*Attorney, Agent, or Firm*—Buchanan Ingersoll, P.C.; Michael L. Dever

[57] ABSTRACT

A sintered hardmetal (cemented tungsten carbide) product has a core made of a first grade of cobalt or nickel bonded cemented tungsten carbide with a surface layer of a second grade of distinctively different cobalt or nickel bonded cemented tungsten carbide. The first grade, or core, is generally a relatively tough (impact resistant or shock resistant) grade of cobalt or nickel bonded hardmetal while the surface layer is a relatively hard (wear resistant) grade of cobalt or nickel bonded hardmetal. The surface layer may, however, be designed to provide corrosion resistance or crater resistance to the article. If desired, multiple layers can be provided with gradient layers included between the core and surface layer. Typical uses of such layered composite carbide articles are as tool materials such as cutting tools or cutting tool inserts, mining tools or wear parts of any design typically manufactured in the cemented carbide industry.

10 Claims, 10 Drawing Sheets

LAYERED COMPOSITE CARBIDE PRODUCT AND METHOD OF MANUFACTURE

BACKGROUND OF THE INVENTION

1. Field of the Invention

The present invention relates to hardmetals, specifically cemented tungsten carbides, which are produced by powder metallurgical procedures, including liquid phase sintering, and are typically comprised of a refractory metal carbide, principally tungsten carbide, but possibly including carbides of tantalum, titanium, niobium, columbium or others, and a binder metal, generally cobalt or nickel or a combination thereof. Hardmetals of this type are composites, and have been produced commercially for at least 60 years, having application as cutting tool materials, mining tools, dies and punches of all sorts, and wear parts.

2. Description of the Prior Art

Properties of cemented carbides range from high hardness (high wear resistance) to high toughness (high strength), but may also include excellent corrosion or oxidation resistance and resistance to galling in certain applications or to welding to the work material (cratering) in other applications. These properties are primarily controlled by the composition of the hardmetal and by the size and shape of the metal carbides. The amount or proportion of binder metal plays an extremely important role in determining hardmetal properties; low levels of binder create a hardmetal exhibiting high hardness and high levels of binder create a hardmetal exhibiting more toughness or strength. Improvement in either of these properties is generally accompanied by a decrease in one or more of the other properties.

Binder metal content may vary from as low as 1% by wt. of the hardmetal composition to as high as 25% by wt. Cobalt is the predominant binder metal, but nickel may be used either by itself or in combination with cobalt to provide improved corrosion resistance in certain applications.

Scientists and metallurgists have long sought ways to improve one or more properties of hardmetals without an accompanying decrease in other properties. For instance, it has long been known that the properties of hardmetals can be improved by joining them with other materials to create composite materials. For example, the strength of a hardmetal product can be improved by clamping or brazing or even by casting the hardmetal onto or into a relatively tough base material such as steel. In so doing, the wear resistance (hardness) property of the hardmetal is not compromised, while the toughness (strength) of the new composite product is improved. Brazed hardmetal on steel plates or steel tool holders are typical applications for such composites.

Conversely, the hardness or wear resistance property of a cemented carbide hardmetal can be improved by coating the hardmetal with an even harder material such as TiN, $Al_2O_3$, TiC, or other materials. In such products the relatively high strength property of the hardmetal (relative to the coating) is not compromised while the wear resistance of the new composite product is improved.

In the products discussed above, the composites are comprised of dissimilar materials. It is often desirable to form these composites of similar materials. Use of similar materials in the composite may provide superior toughness, wear resistance, or corrosion resistance properties without sacrificing any of the other properties within the hardmetal article itself.

Very few composites formed from similar materials are known. One such composite is disclosed in U.S. Pat. No. 4,722,405 to Langford in which two different grades of hardmetal compositions are compacted together in a manner in which one-half of the article is comprised of a first grade of cemented carbide composition and the other half is comprised of a second grade of cemented carbide composition. When sintered, this composite of composites may be comprised of two distinctively different hardmetal compositions, and the line of demarcation between them may be horizontal or vertical. However, Langford does not provide a composite in which the entire surface or selected surfaces are different in composition and properties from the core of the article.

Fischer et al., U.S. Pat. No. 4,743,515, discloses a hardmetal product having a property gradient from its surface to the core of the article. Specifically, the hardmetal product has a relatively high hardness at the surface and a relatively high toughness at the core. This result is created by controlling the cobalt binder content of the product such that the cobalt content is relatively low at the surface with progressively higher binder content toward the center or core.

In the Fischer et al. composite, the control of the binder content is provided by means of a diffusion or migration process which causes the concentration of binder metal to be lower at the surface than in the core, thereby creating the property differential. This composite cannot provide a product having distinctively different cemented carbide grade compositions, grain sizes or alloy contents in selected surfaces or on all surfaces as needed for certain applications.

Jacobs et al, U.S. Pat. No. 4,956,012, discloses a composite in which nodules of one grade of hardmetal composition are dispersed uniformly in a matrix of another grade of hardmetal composition. There is no gradient in property or composition from surface to core in such a composite. Moreover, such a composite is unable to produce articles having distinctly different compositions in selected surfaces since the Dispersion Alloyed Composite Carbide disclosed therein is a uniform mixture throughout the composite.

Drake, U.S. Pat. No. 4,398,952, describes a powder metallurgical article having a continuous mechanical property gradient from core to surface. This gradient is produced by a powder metals production technique which entails a continuous change of composition of the powder metal from core to surface or vice versa. The properties of an article produced by this method have a continuous gradient from core to surface rather than having a distinct separation in grade between core and surface or selected surfaces. In addition, the method disclosed in Drake for producing such a composite is cumbersome and expensive and is not suitable for carbide component production.

Steigelman et al., U.S. Pat. No. 4,003,716, discloses a tape cast cemented refractory metal carbide having improved sintered density. In Steigelman et al., a cemented carbide article is produced by tape casting a slurry, forming the cast tape into a desired shape and firing the tape. If one attempted to apply the flexible product from this invention to a sintered or unsintered product, problems would occur. For instance, difficulties arise in bonding the tape cast to a core, especially where the core has not been previously sintered. Accordingly, the production of a layered composite carbide product has been difficult to accomplish.

SUMMARY OF THE INVENTION

The present invention describes a successful means of improving one or more properties of hardmetals without the accompanying decrease in other properties. The present invention accomplishes this improvement by creating a layered composite carbide article which is actually a composite of composites since all cemented carbides are composites. The present invention provides a sintered composite hardmetal product in which the core is comprised of a first grade of cemented carbide composition and the surface, or selected surfaces, is comprised of a distinctively different composition or compositions, which are therefore of distinctively different mechanical properties from the core.

DETAILED DESCRIPTION OF THE PREFERRED EMBODIMENTS

Figure 1A:
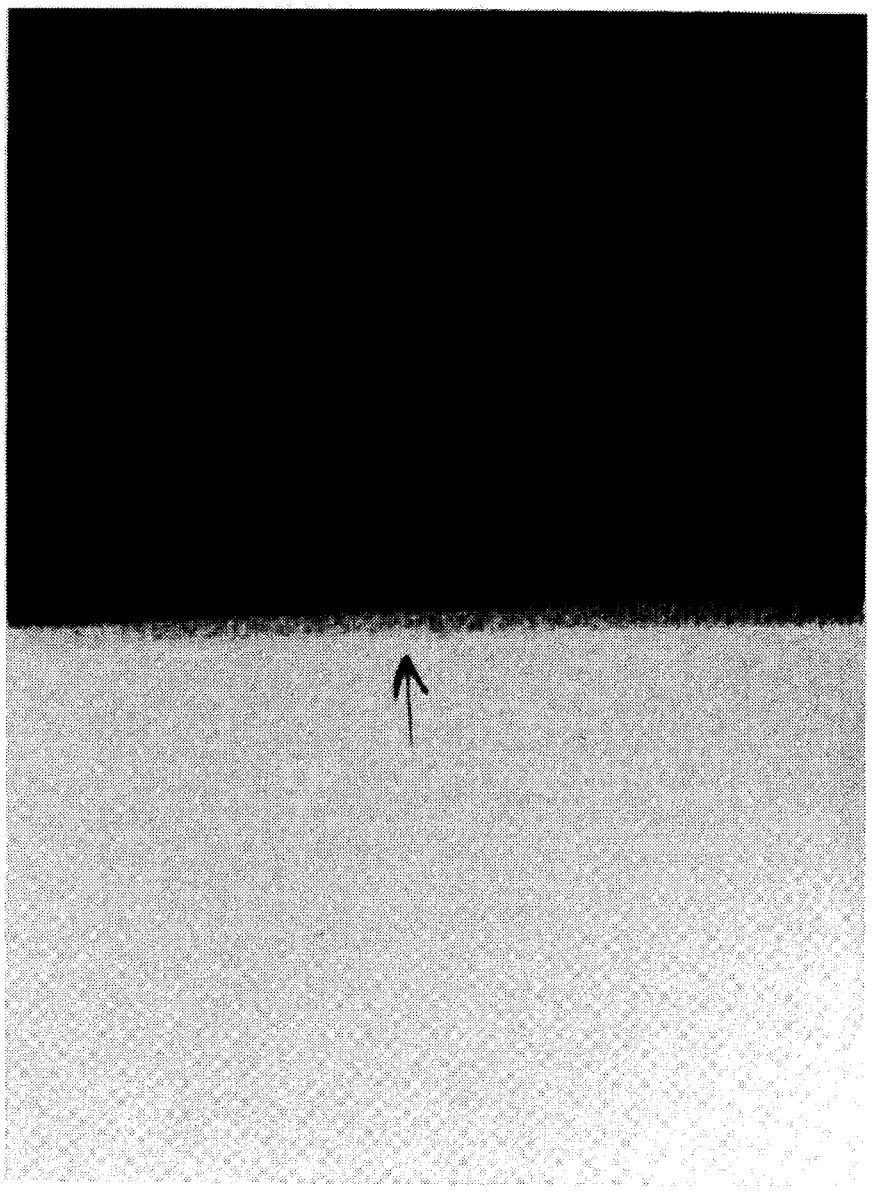
FIG. 1A is a photomicrograph of a presently preferred embodiment of a flat-topped layered composite carbide product of the present invention showing at 16.5 magnification the surface layer and core body of the composite.
Figure 1B:
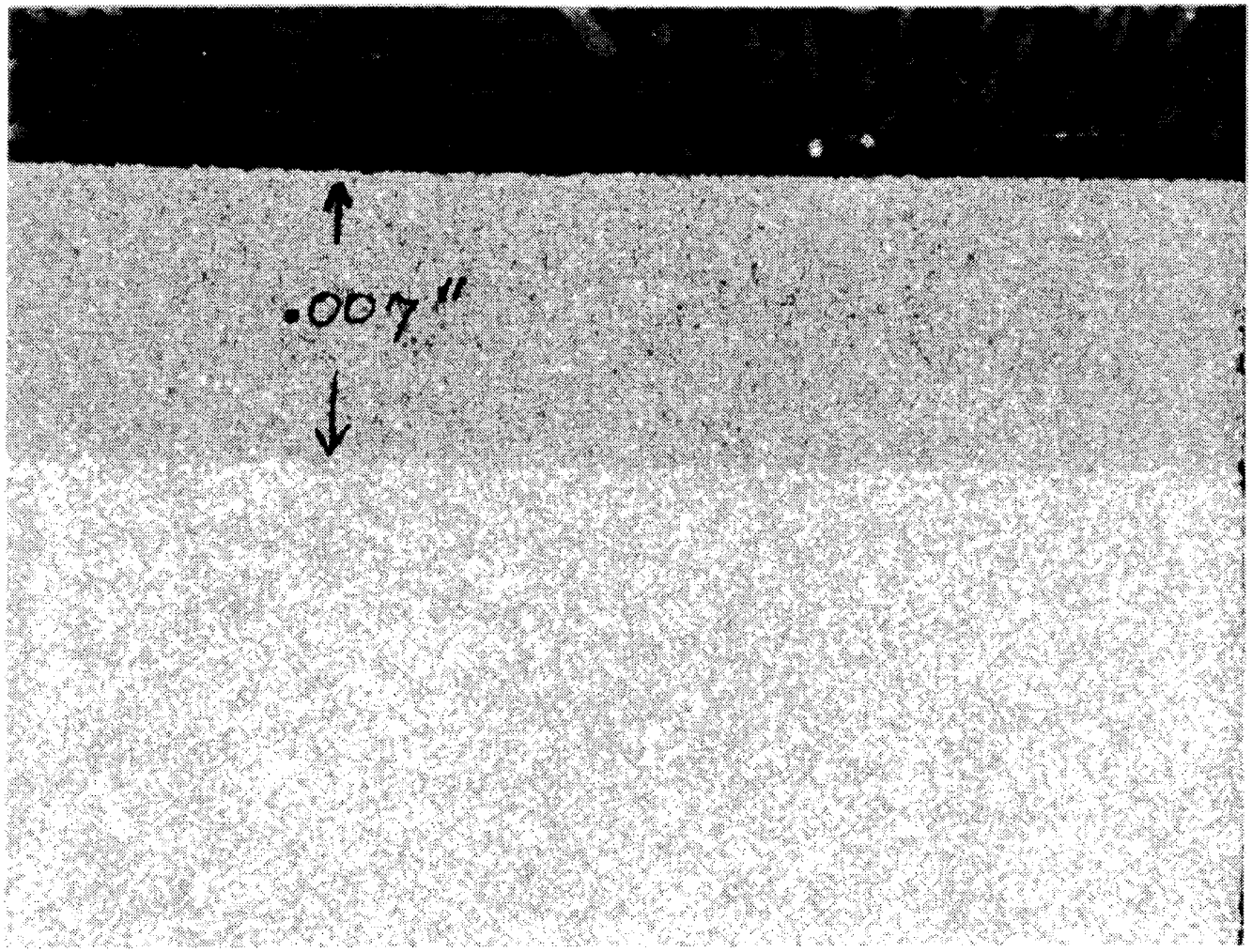
FIG. 1B is a photomicrograph of the layered composite carbide product of FIG. 1A showing at 150 magnification the surface layer and core body of the composite.
Figure 1C:
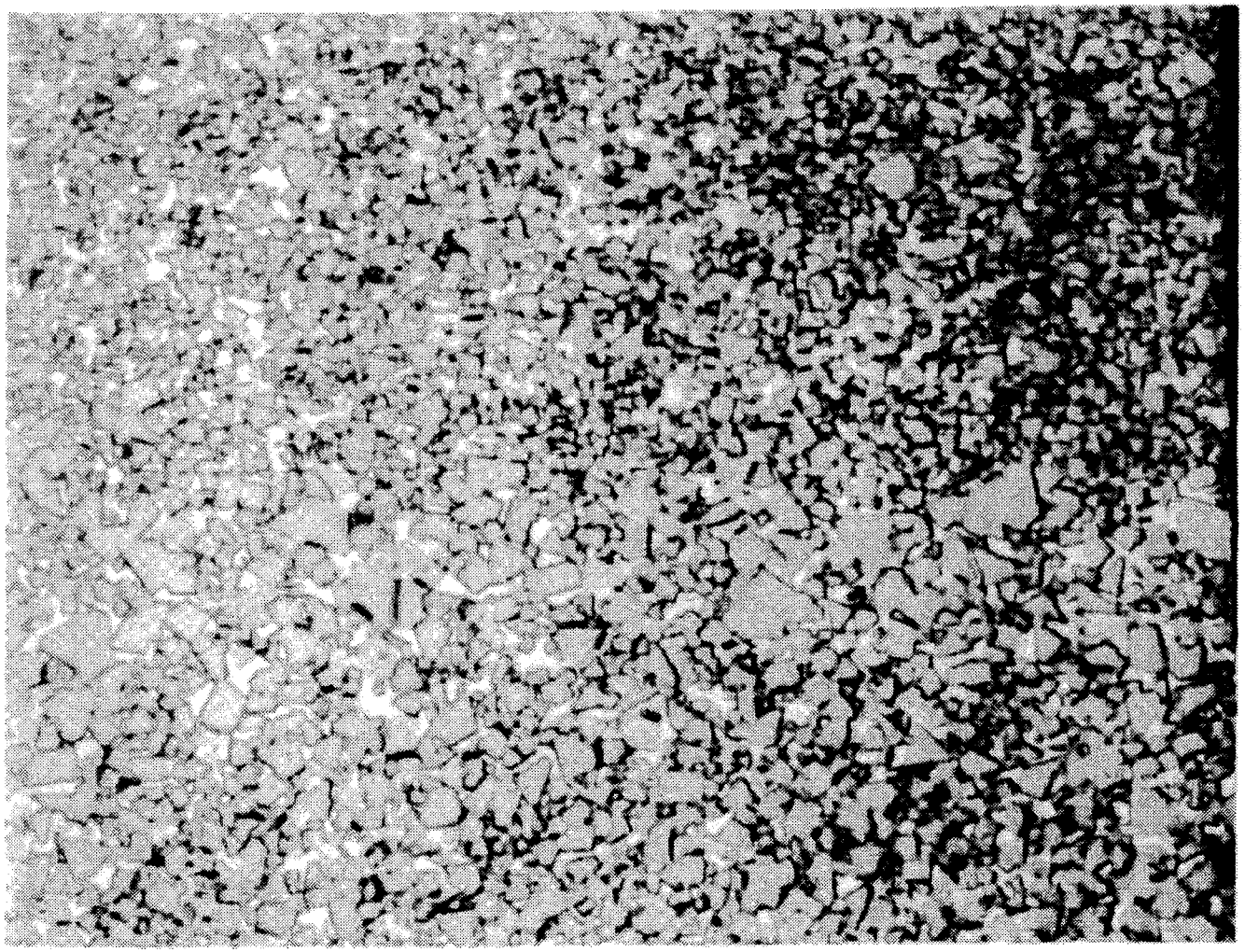
FIG. 1C is a photomicrograph of the layered composite carbide product of FIG. 1A showing at 1500 magnification the surface layer and core body of the composite.

FIGS. 1A, 1B, and 1C are photomicrographs of a layered composite formed in accordance with the present invention in which the article or body is a flat-topped or flat-sided article. As shown in FIG. 1A, the article has a surface layer that is distinctly different than the core or body. Yet, the surface layer is uniform in its thickness and composition. FIG. 1B shows the structure of the composite at 150×, in which the surface layer (which is 0.007" thick in this case) is a distinctly different grade from the core. FIG. 1C shows the bond line of Panel B at 1500×. FIGS. 1A, 1B, and 1C clearly show that the top surface grade is a fine grained grade while the core is a medium grained grade. These Figures further show an excellent bond between the surface layer and the core, proving that consolidation of each layer and between each layer is complete.

Figure 2A:
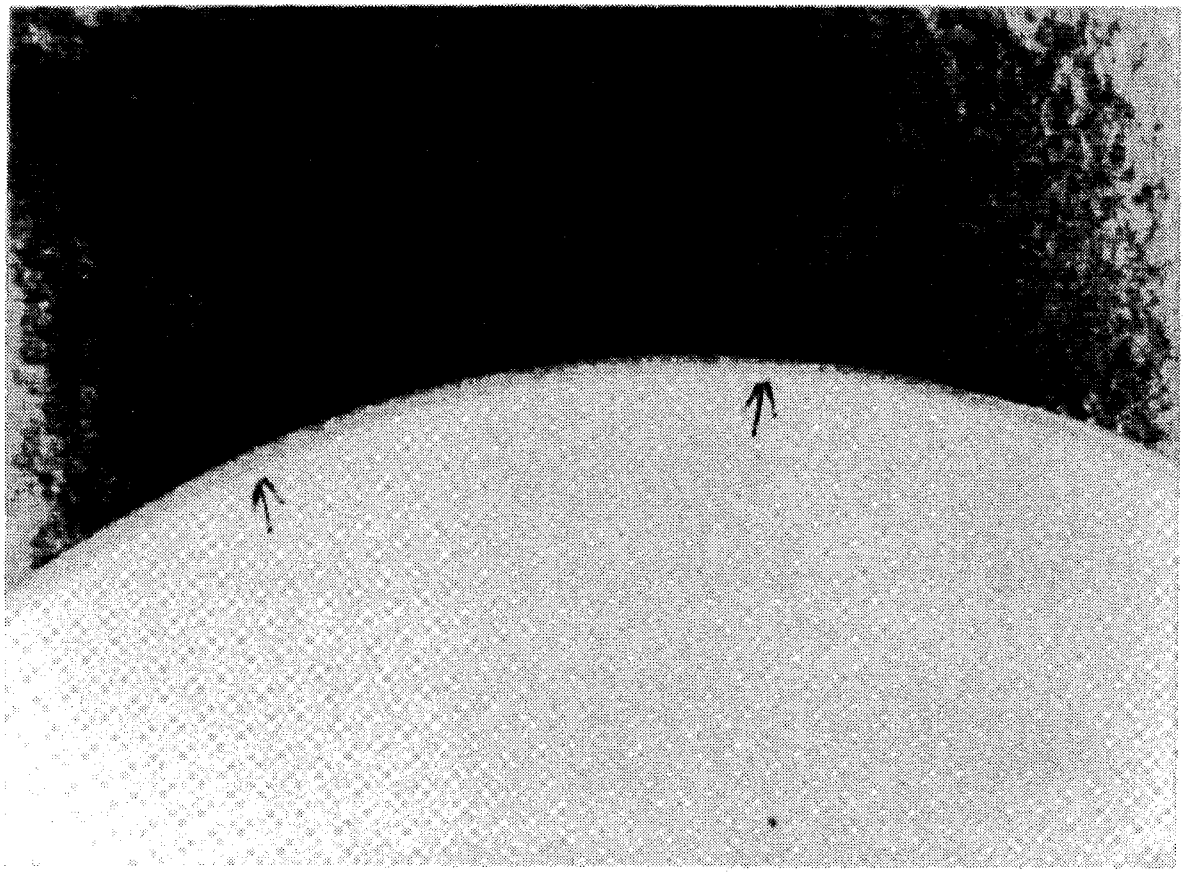
FIG. 2A is a photomicrograph of a presently preferred embodiment of a spherical layered composite carbide product of the present invention showing at 16.5 magnification the surface layer and core body of the composite.
Figure 2B:
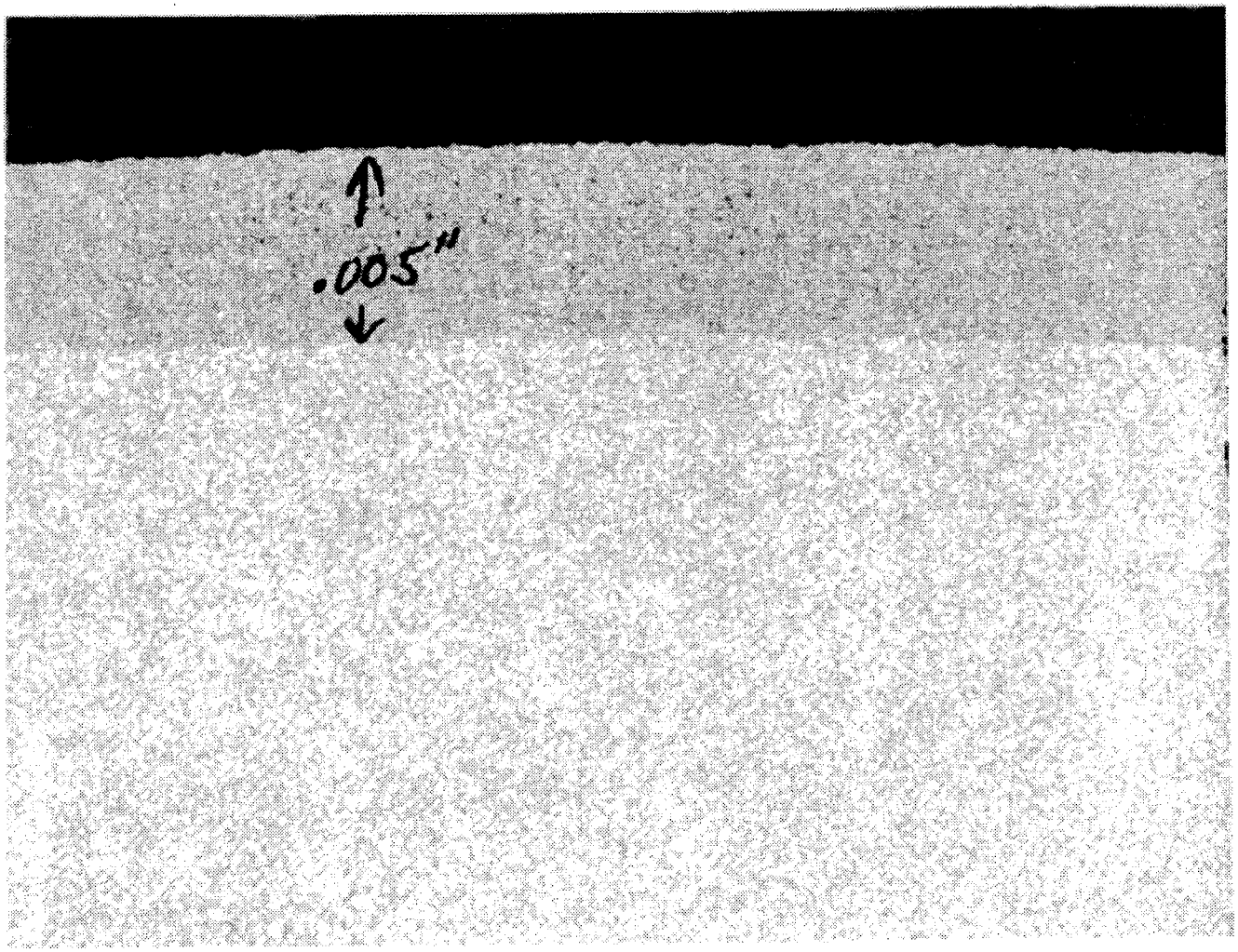
FIG. 2B is a photomicrograph of the layered composite carbide product of FIG. 2A showing at 150 magnification the surface layer and core body of the composite.
Figure 2C:
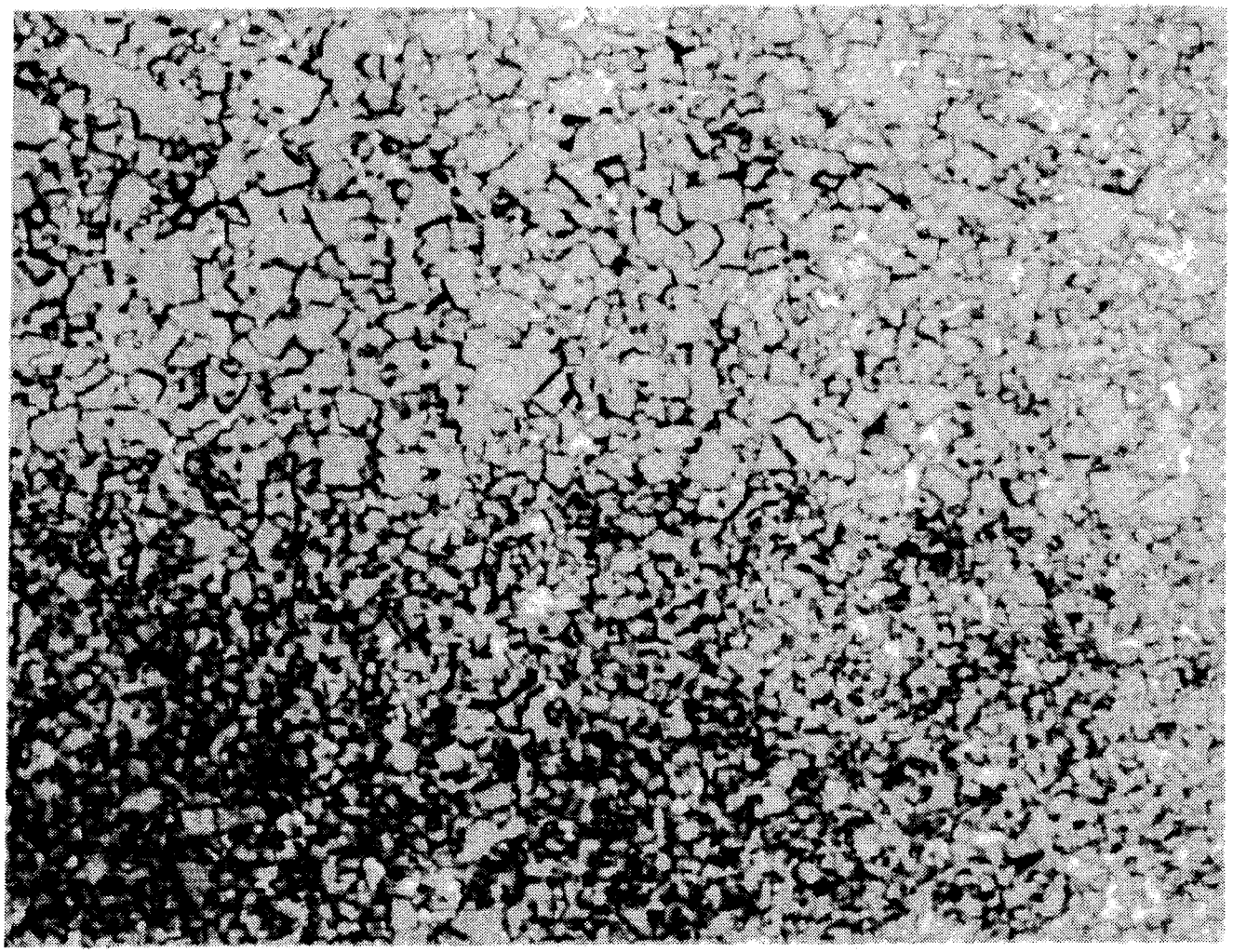
FIG. 2C is a photomicrograph of the layered composite carbide product of FIG. 2A showing at 1500 magnification the surface layer and core body of the composite.

FIGS. 2A, 2B, and 2C are micrographic photos of a dome-topped or spherical compact according to the present invention in which the top surface is distinctly different from the core. FIGS. 2A, 2B, and 2C show that the process of the present invention is also applicable to contoured surfaces, as well as flat surfaces, as clearly seen in FIGS. 2B and 2C.

Figure 3A:
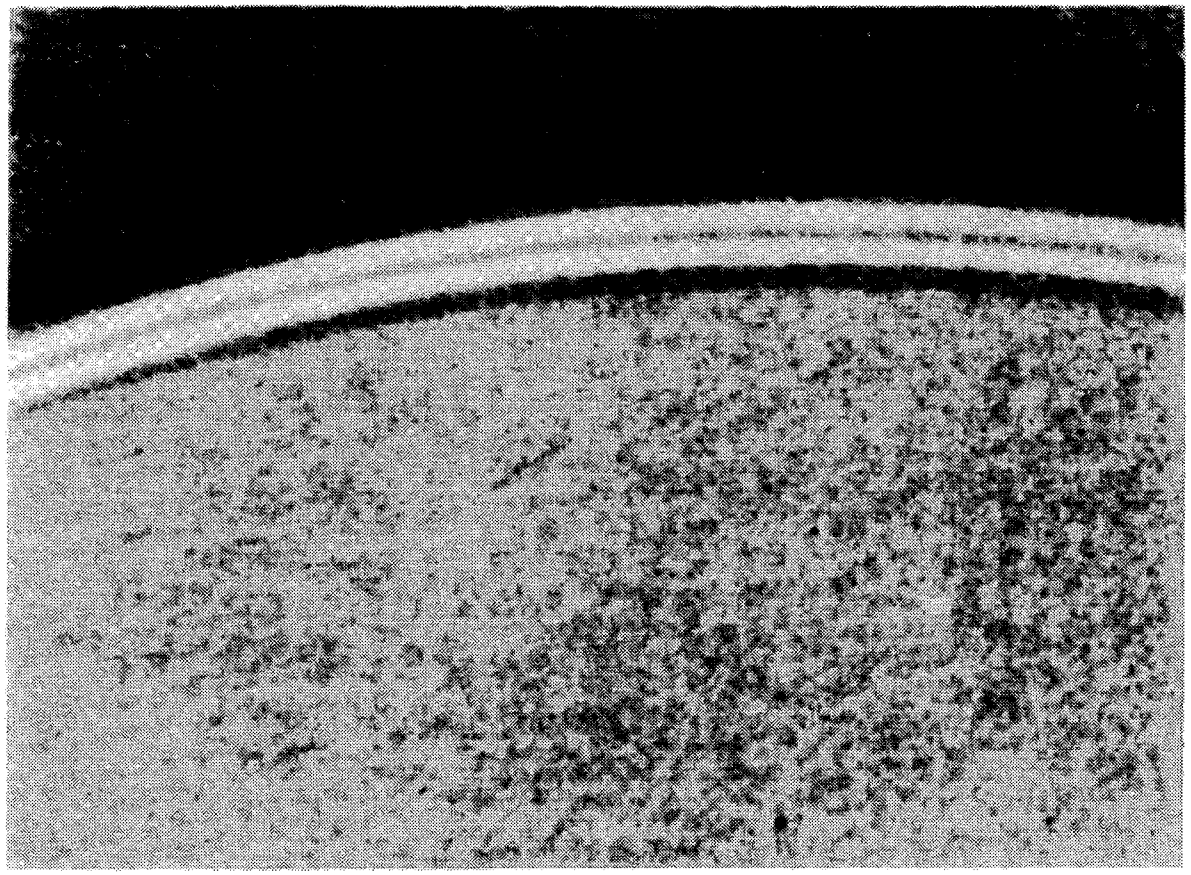
FIG. 3A is a photomicrograph of a presently preferred embodiment of a spherical multiple layered composite carbide product of the present invention showing at 42.5 magnification five separate layers and core body of the composite.
Figure 3B:
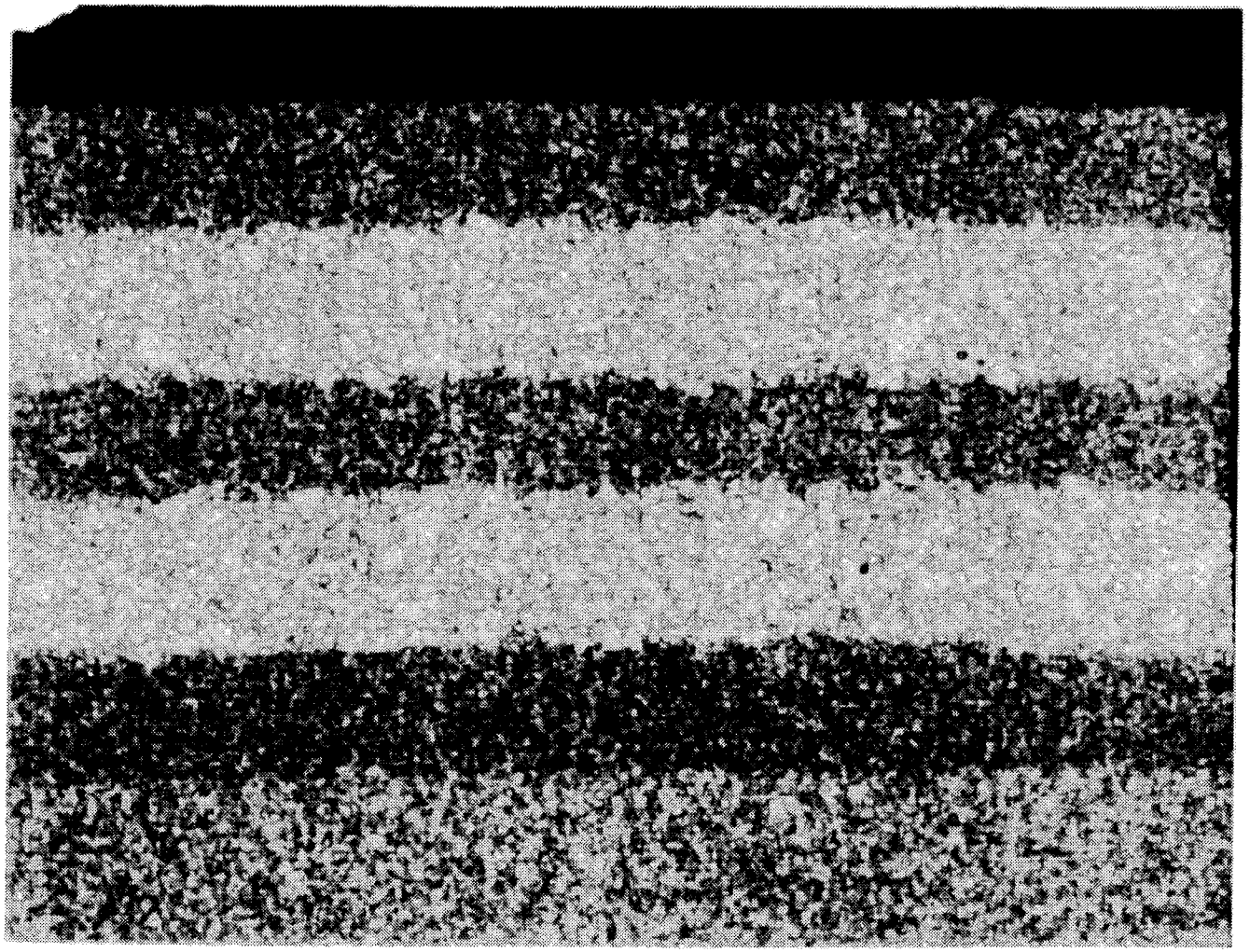
FIG. 3B is a photomicrograph of the layered composite carbide product of FIG. 3A showing at 200 magnification the five layers and core body of the composite.
Figure 3C:
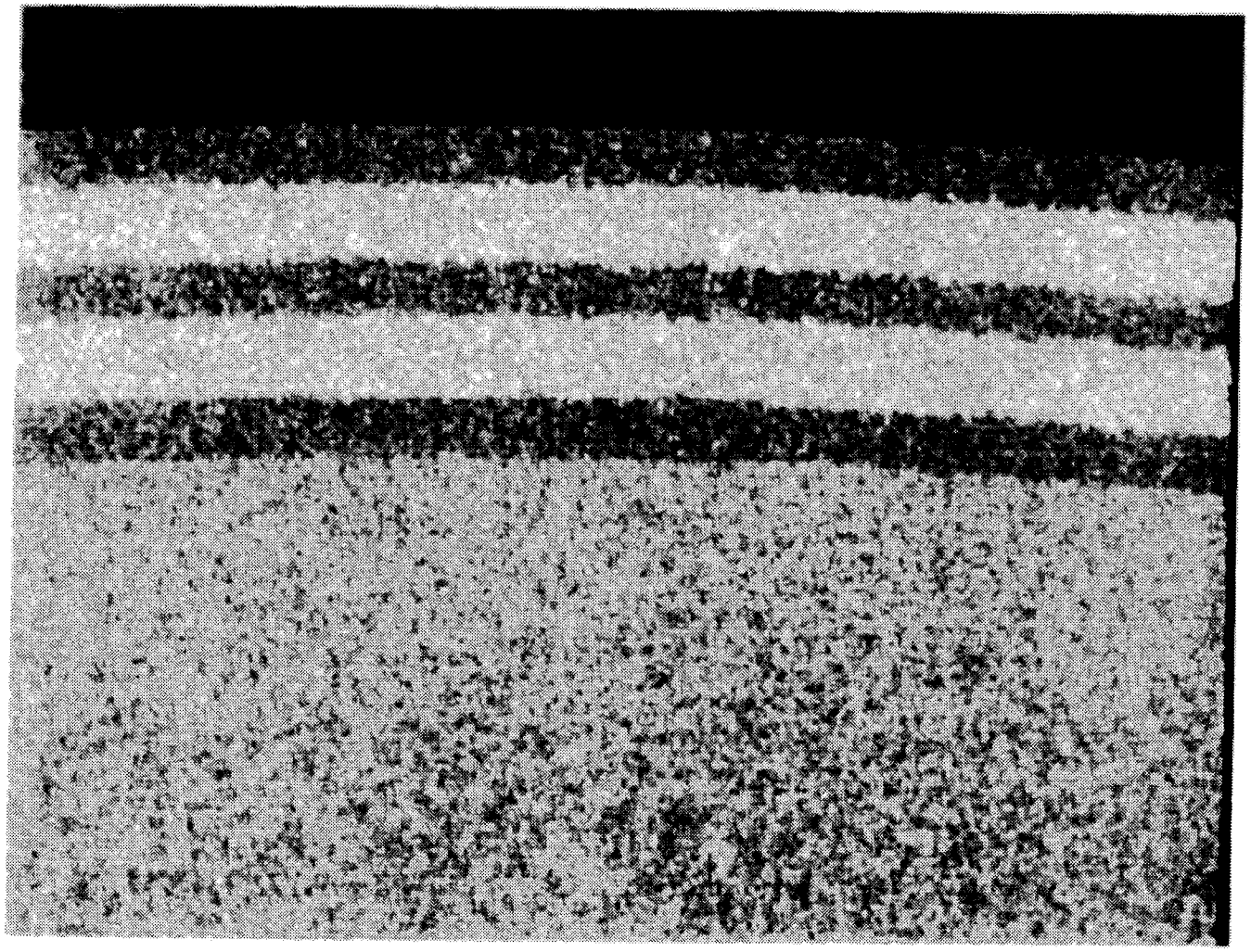
FIG. 3C is a photomicrograph of the layered composite carbide product of FIG. 3A showing at 100 magnification the five layers and core body of the composite.

FIGS. 3A, 3B, and 3C show that the process of the present invention is not only capable of providing layered hardmetal composites in contoured shapes, but can also provide a multiplicity of layers, in which each may be distinctly different from each other and from the core. This multiplicity of layers is also shown in FIG. 3A. FIGS. 3B and 3C show the layers at higher magnifications, clearly displaying the differences in structure from each other and from the core. The "layers" described herein may range in thickness from as little as 0.001" to as much as 20% of the overall thickness of the sintered part.

Figure 4:
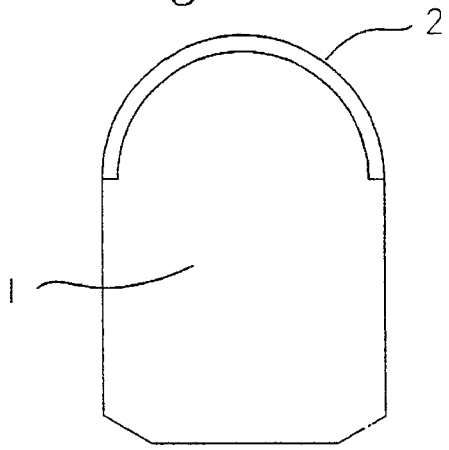
FIG. 4 is a cross-sectional side elevational view of a first presently preferred embodiment of a spherical shaped mining compact formed in accordance with the present invention.

FIGS. 4–9 illustrate various embodiments in which the layered composite carbide product of the present invention can be formed. In a preferred embodiment of the invention, shown in FIG. 4, a spherical (dome) shaped mining compact or tool can be produced in which the core 1 is a relatively tough (impact resistant) grade of cemented carbide having a relatively high cobalt composition (above 8% by wt.), or a coarse grained structure, or both. Top surface layer 2 is a relatively hard (high wear resistance) material which is formed from a second grade of cemented carbide having relatively low cobalt composition (6% by wt. or less), or fine grained structure, or both. Such a layered composite carbide product as shown in FIG. 4 provides a solid hardmetal mining tool having improved mechanical properties compared to either the tough core or the hard surface by virtue of their combination into one body, with controlled compositions and properties in the different regions of the sintered product.

The composite shown in FIG. 4 would find many applications in rock drilling or mining applications and would provide improved performance over present hardmetal compositions because of its high hardness top surface, whose composition and property does not deleteriously affect the impact resistance of the core.

Figure 5:
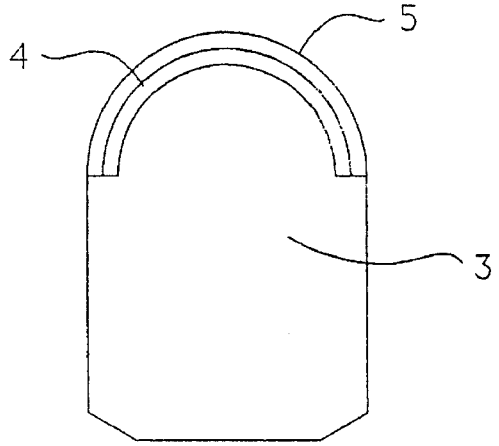
FIG. 5 is a cross-sectional side elevational view of a second presently preferred embodiment of a spherical shaped mining compact formed in accordance with the present invention.

FIG. 5 illustrates a second preferred embodiment of the mining tool described above in which the core 3 is a relatively hard grade of cemented carbide and an intermediate layer 4 is provided having high shock resistance. A top surface layer 5 of the composite can have a composition similar to the core or can be of a different composition. Alternatively, the top layer 5 can be of an even higher wear resistance grade than the core. The mining tool of FIG. 5 is specially designed to protect the core 3 from cracks originating in surface top layer 5. The shock resistance properties of intermediate layer 4 provide this protection to core 3. Even if top layer 5 chips off, intermediate layer 4 protects core 3 by preventing crack propagation.

It is desirable when forming multi-layer composites that the layers exhibit a gradient in properties form the core to the surface. For instance, it is desirable that a gradient exists in the thermal expansion coefficient for each of the layers. This gradient in properties allows the sintered composite to form as a solid piece without fracturing.

Figure 6:
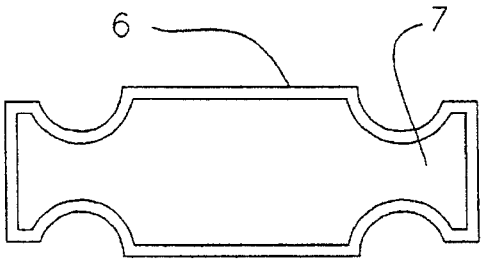
FIG. 6 is a cross-sectional side elevational view of a first presently preferred embodiment of an indexable cutting tool insert formed in accordance with the present invention.

FIG. 6 illustrates a third preferred embodiment in which an indexable cutting tool insert product can be produced either with or without holes and with or without chipbreakers. The core 7 of this insert can be a tough, impact resistant composition and the surface 6 can be a highly wear resistant or corrosion resistant or crater resistant grade. The insert shown in FIG. 6 is highly desirable in metal cutting applications because it allows the production of tool materials with either improved wear resistance, compared to present hardmetal tools, or improved impact resistance, whichever is necessary to combat the current failure mode.

Figure 7:
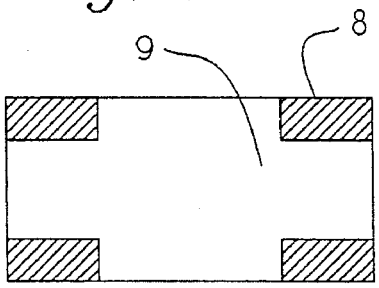
FIG. 7 is a cross-sectional side elevational view of a second presently preferred embodiment of an indexable cutting tool insert formed in accordance with the present invention.

FIG. 7 shows a fourth preferred embodiment in which only the exposed cutting edges 8 of a solid hardmetal body 9 consist of a grade distinctively different than the body. Such configuration may be useful in the case in which the application requires a greater proportion of an impact resistant core material relative to the highly wear resistant cutting edges, which will be more brittle than the body. Alternatively, when the separate surface grade of hardmetal is expensive relative to the core material, the premium grade can be used only on the cutting edges to conserve such material.

Figure 8:
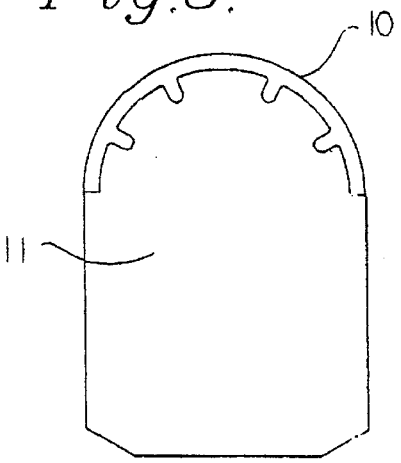
FIG. 8 is a cross-sectional side elevational view of a third presently preferred embodiment of a spherical shaped mining compact formed in accordance with the present invention.

FIG. 8 shows another embodiment of the present invention in which the top surface layer 10 is extended into grooves in the core 11 in order to provide a deeper (thicker) top surface layer.

Figure 9:
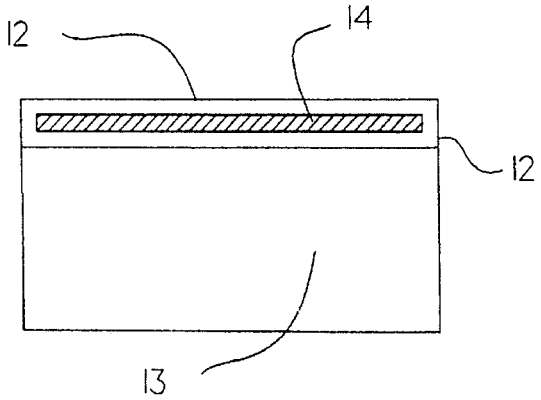
FIG. 9 is a cross-sectional side elevational view of a third presently preferred embodiment of an indexable cutting tool insert formed in accordance with the present invention.

FIG. 9 shows another embodiment of the present invention in which an intermediate layer 14 of a distinctly different grade is encased in a separate top layer 12 over a body 13.

METHOD OF MANUFACTURE

Manufacture of the layered composite carbides described above requires the production of a hardmetal powder containing a typical mixture of metal carbide powder and binder metal powder or powders by any of the techniques commonly used for such purpose. These include ball milling, attrition milling or vibratory milling followed by drying to remove any solvent.

The dried powder metal mixture is then admixed with a liquid vehicle to produce a slurry of the consistency of latex paint. Such a vehicle is described in Steigelman et al., U.S. Pat. No. 4,003,716, discussed above, in which very thin hardmetal components or laminates are produced by the steps of creating flowable compounds of the hardmetals, drying the compounds, laminating the compounds together with each other if desired, and then sintering in graphite mold forms to create the sintered articles.

The liquid vehicle in which the dried powder metal mixture is admixed is composed of:

1. solvents, toluene and ethyl alcohol to dissolve the other constituents of the liquid vehicle and control the viscosity of the slurry;

2. deflocculent or surfactant, such as Kellox 23 Fish Oil, to keep the powder particles in suspension and prevent the particles from clumping together;

3. plasticizer, such as Santicizer 160, to improve the distribution of the binder in the slurry and provide flexibility to the slurry after it is deposited onto the core and dries; and 4. a binder, such as Butvar B79, to dissolve in the solvent and alter the viscosity of the slurry by binding the powder particles together after the slurry dries.

The slurry consistency can be altered by changing the relative amount of solvent and binder in the above mixture.

A successful mixture contains:

1 kg. graded hardmetal powder;
1.67 wt % powder Kellox 23 Fish Oil;
15.0 wt % powder toluene;
5.0 wt % powder ethyl alcohol;
1.42 wt % powder Santicizer 160; and
4.69 wt % powder Butvar B79;

The mixture is ball milled for six hours in a nalgene container containing a carbide ball mill media to facilitate mixing.

The processed slurry may then be applied by spraying or painting onto the surface of any unsintered green compact made of pressed, compacted or formed hardmetal powder of any grade from which all fugitive binders have been previously removed. Such compacts ultimately become the cores or bodies of the sintered articles. The slurry may also be applied by submersing or dipping the compacted, debinderized or pre-sintered hardmetal compacts into the slurry.

The slurry is then permitted to dry in air, after which the compact(s) with the dried slurry surfaces may be sintered using hardmetal sintering or sinter-hipping techniques. Alternatively, if desired, additional layers of slurry may be applied by repeating the above steps. Re-application of the same slurry results in a thickening of the surface layer of that particular grade composition. If desired, different slurries made with other hardmetal grades may be applied to create multi-layered composite carbides.

When the above-described method is followed, a layered composite can be produced in which the surface layer successfully bonds with the core. The problems of surface layer adhesion encountered with the prior art techniques are overcome with this method.

The possibilities of laminating various layers by depositing, painting or spraying such slurries are myriad, and the various embodiments shown herein are only examples of those possibilities. While certain present preferred embodiments have been shown and described, it is distinctly understood that the invention is not limited thereto but may be otherwise embodied within the scope of the following claims.

What is claimed is:

1. A method of making a rigid sintered hardmetal component having a core of a first grade of a hardmetal composition and at least one surface layer of a second hardmetal grade comprising the steps of:

a. manufacturing a slurry containing a powder of said second hardmetal grade as the particulate constituent of the slurry and a liquid vehicle consisting essentially of hydrocarbons, said liquid vehicle including solvents, surfactant, binder and plasticizer;

b. applying said slurry to a surface of a green compact, said green compact being formed from said first hardmetal grade;

c. allowing the slurry to dry on said green compact to form a green layered composite; and d. sintering said green layered composite to form said rigid sintered hardmetal component.

2. The method of claim 1 further comprising the step of adjusting the viscosity of the slurry prior to applying the slurry to the surface of said green compact.

3. The method of claim 1 wherein said green compact includes a fugitive binder, further comprising the step of removing said fugitive binder by a debinderizing process selected from the group of processes consisting of pre-sintering, half-sintering, and delubing.

4. The method of claim 1 wherein said green compact is produced from a hardmetal powder, said hardmetal powder being made without any fugitive binder.

5. The method according to claim 1 in which said slurry is only applied to a top surface of said green compact, whereby a layered composite product is produced in which only the top surface contains a hardmetal grade that is different from the body of the article when sintered.

6. The method according to claim 1 in which said slurry is applied to the entire surface of said green compact, whereby a layered composite carbide article is produced in which the entire surface of said layered composite carbide article contains a grade of hardmetal which is different from the core of the article when sintered.

7. The method according to claim 1 in which said slurry is applied to selected surfaces of said green compact, whereby a layered composite carbide article is produced in which selected surfaces of said article contain a grade of hardmetal that is different from the core or body of the article when sintered.

8. The method according to claim 1 in which the slurry is applied to said green compact by at least one of the methods of painting, spraying and otherwise depositing said slurry onto said green compact.

9. The method according to claim 1 in which said slurry is applied to said green compact by at least one of the methods of submersing and dipping said green compact into the slurry.

10. A rigid sintered article made according to the method of claim 1.

* * * * *